United States Patent [19]

Frentzel-Beyme

[11] Patent Number: 4,568,038

[45] Date of Patent: Feb. 4, 1986

[54] THREAD BRAKE

[75] Inventor: Johannes Frentzel-Beyme, Monchen-Gladbach, Fed. Rep. of Germany

[73] Assignee: Palitex Project-Company GmbH, Fed. Rep. of Germany

[21] Appl. No.: 659,162

[22] Filed: Oct. 9, 1984

[30] Foreign Application Priority Data

Oct. 8, 1983 [DE] Fed. Rep. of Germany ..... 3336715

[51] Int. Cl.[4] ..... B65H 59/24

[52] U.S. Cl. ..... 242/152.1

[58] Field of Search ..... 242/152.1, 149, 147 R, 242/150, 151, 152, 129.8, 157 R, 157 C; 226/196; 57/279, 280, 58.86

[56] References Cited

U.S. PATENT DOCUMENTS

| | | | |
|---|---|---|---|
| 826,876 | 7/1906 | Palmer | 242/157 C |
| 1,785,987 | 12/1930 | Stewart | 242/152.1 |
| 2,373,513 | 4/1945 | Stevenson | 242/152.1 |
| 3,210,881 | 10/1965 | Wilson | 242/157 R |
| 3,945,184 | 3/1976 | Franzen | 242/149 X |
| 4,405,094 | 9/1983 | Scheufeld et al. | 242/149 |
| 4,468,920 | 9/1984 | Lorenz | 242/149 X |

FOREIGN PATENT DOCUMENTS

| | | | |
|---|---|---|---|
| 2050490 | 4/1972 | Fed. Rep. of Germany . | |
| 19365 | of 1909 | United Kingdom | 242/152.1 |
| 6576 | of 1910 | United Kingdom | 242/152.1 |
| 1965 | of 1915 | United Kingdom | 242/152.1 |

*Primary Examiner*—Stanley N. Gilreath

*Attorney, Agent, or Firm*—Bell, Seltzer, Park & Gibson

[57] ABSTRACT

A thread brake for a two-for-one twisting spindle or twisting station having a tubular brake housing with a thread inlet opening arranged in the axis thereof and having a brake surface ring received in the brake housing and arranged at an axial distance from the thread inlet opening with an annular opening of the brake surface ring being arranged coaxially to the axis of the brake housing, and a circular brake element cooperating with the brake surface ring. The thread passes concentrically through the thread brake utilizing a by-pass passage which is arranged within the brake housing which passage extends laterally of the annular opening of the brake surface ring, and the by-pass passage is followed, in radial section, by a spirally curved slot leading to the annular opening of the brake surface ring.

1 Claim, 2 Drawing Figures

THREAD BRAKE

BACKGROUND AND OBJECTIVES OF THE INVENTION

I. Field of the Invention

This invention relates to a thread brake for a two-for-one textile spindle.

II. Description of the Prior Art

A thread brake of this general nature is described in DE-OS 20 50 490 and may be the sole braking system for a thread in the range of a processing station or such a thread brake may be associated with a further braking point as a preceding or subsequent brake in the thread line.

In the threading-in or threading-through of a yarn or thread, particularly in the pneumatic threading, it is either necessary to provide for an unobstructed passage for the thread, namely, by lifting the brake element off the brake surface ring, or to provide for a by-pass passage extending parallel to the actual braking point which is formed by the brake surface ring and the brake element as described, e.g., in DE-PS 30 15 182, corresponding to U.S. Pat. No. 4,405,094. In such a pneumatically threadable brake, the thread may be pneumatically passed laterally of the actual braking point so that, upon tensioning of the thread during the start-up of the processing station, the thread is drawn through a lateral slot in the brake surface ring, into the annular opening thereof. In the thread brake as described in DE-PS 30 15 182, the annular opening of the brake surface ring is radially offset with respect to the thread inlet openings so that, during ordinary travel of the thread through the thread brake, varying thread tensions will occur during the movement of the thread around the brake element or the axis of the brake housing, respectively.

SUMMARY AND OBJECTIVES OF THE INVENTION

This invention relates to a thread brake comprising a tubular brake housing with a thread inlet opening arranged in the axis thereof, further comprising a brake surface ring received in said brake housing and spaced by an axial distance from said thread inlet opening, the annular opening of said brake surface ring being arranged coaxially to the axis of said brake housing, and a circular brake element cooperating with said brake surface ring.

Therefore, an objective of this invention is to provide a thread brake for a thread concentrically traveling through said thread brake in a manner such that a pneumatic threading-through of the thread may be obtained in the most simple brake construction.

In order to solve the aforementioned problem, the thread brake, according to the present invention, is characterized by a by-pass passage provided within the brake housing and extending laterally of the annular opening of the brake surface ring, and by a slot which, in radial section, starts from one end of said by-pass passage and extends in a spiral curve to said annular opening of said brake surface ring.

Preferably, the by-pass passage, in radial section, is substantially in the form of an inwardly curved flat spiral, the tip of which is located in the annular opening of the brake surface ring.

BRIEF DESCRIPTION OF THE DRAWING OF A PREFERRED EMBODIMENT

FIG. 1 is an enlarged axial sectional view of the thread brake according to the invention; and FIG. 2 is a radial section taken along the line A-B of FIG. 1 with the brake element removed from the brake housing.

DETAILED DESCRIPTION OF PREFERRED EMBODIMENT

Figure 1:
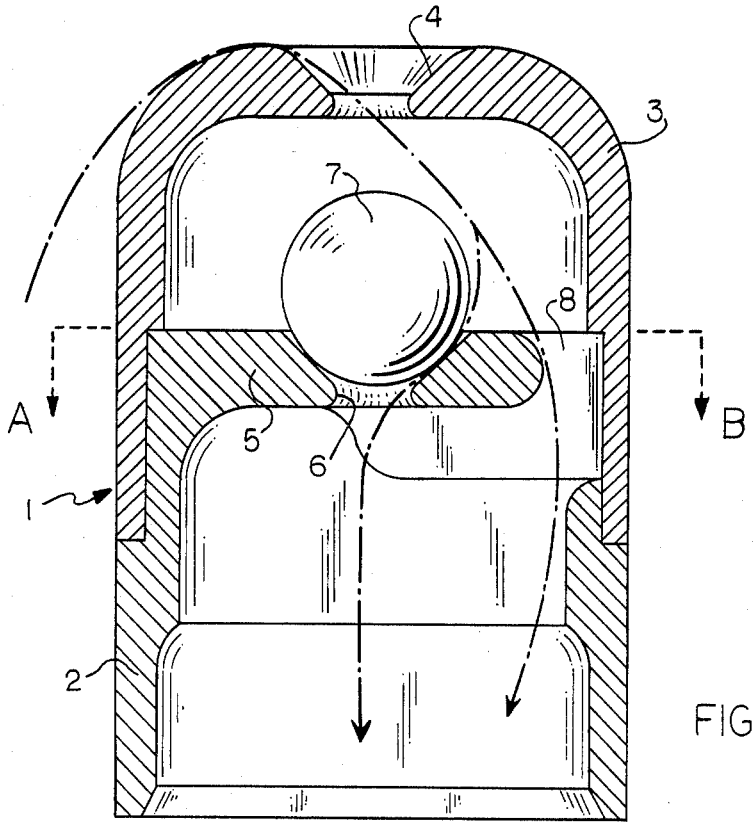

Referring to the drawing, the thread brake comprises a two-part brake housing 1 composed of a lower carrier sleeve 2 and an upper cap 3. The connection between the carrier sleeve 2 and the cap 3 may be established by a force fit whether by screwing or a bayonet joint or the like. A carrier sleeve 2 is adapted to be slipped with its open end over a thread guide tube or the like (not shown). The cap 3 is provided with a central thread inlet opening 4 having a frusto-conical cross-section.

A brake surface ring 5 is cooperatively received in the brake housing which brake surface ring 5 is either secured in the brake housing 1 in a suitable manner or may be integral with the carrier sleeve 2. The brake surface ring 5 has a central annular opening 6 which is located centrally below the thread inlet opening 4. The annular opening 6 is closed by a circular plate-like or ball-like brake element 7 which, in cooperation with the brake surface defined by the annular opening 6 of the brake surface ring, forms the actual braking point.

Figure 2:
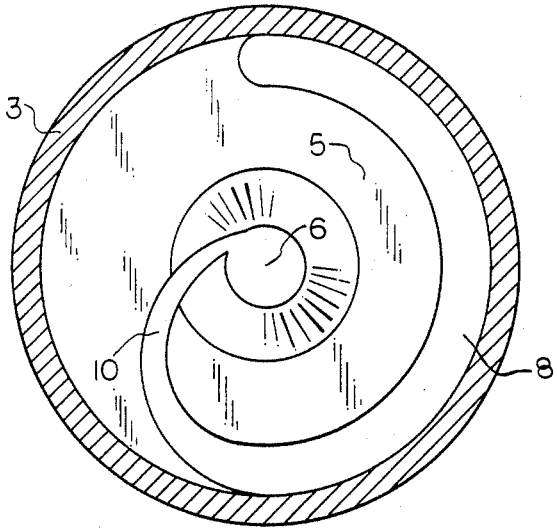

Within the brake housing 1, an arcuate by-pass passage 8 is formed and extends laterally of the annular opening 6 in the brake surface ring 5 for receiving thread, as indicated in FIG. 1, during threading thereof through the brake housing 1 to by-pass the cooperating brake element 7 and brake surface ring 5. A slot 10 is provided in the brake surface ring 5 and extends from the by-pass passage 8 in a spiral curve to the annular opening 6 of the brake surface ring 5, as shown in FIG. 2, for allowing the running thread to pass from the by-pass passage 8 into the annular opening 6 of the brake surface ring 5, as shown in FIG. 1, after threading thereof through the brake housing 1, and upon start-up of the running thread.

In the pneumatic threading-through or threading-in of a through the thread brake, the thread, following the air jet, is transported through the upper thread inlet opening 4 and then laterally of the actual braking point (brake surface ring 5 and brake element 7) and through the by-pass passage 8 and the brake housing 1.

Upon start-up of the processing station which is equipped with the thread brake according to the invention, e.g., a twisting station or a two-for-one twisting spindle, the thread, in its movement around the axis of the brake housing, follows the curvature of the arcuate by-pass passage 8 and automatically threads itself into the spiral slot 10 in the brake surface ring 5 and then into the central annular opening 6 between the actual brake surface and the brake element 7. The thread then remains in this annular opening 6 upon further movement.

The curvature of the arcuate by-pass passage 8 and of the spirally curved slot 10 are chosen, in accordance with the direction of movement of the thread around the central axis of the thread brake, so that the thread will forceably follow the curvature of the by-pass passage 8 and then the slot 10 upon start-up of the running thread to be guided from the outside in an inward direction into the annular opening 6 in the brake ring 5.

Preferably, the thread inlet opening 4 of the cap 3 is of less diameter than the circular brake element 7 so that an unintentional displacement vertically of the brake element 7 from the thread brake is prevented, although it is possible to replace the brake element by other brake elements after the removal of cap 3.

Obviously many modifications and variations may be made to the configuration of the housing and other elements without departing from the purpose and spirit of this invention within the scope of the appended claims.

I claim:

1. A thread brake, particularly for use in a two-for-one twister spindle, comprising:

a tubular brake housing having a thread inlet opening in one end thereof and along the axis thereof;

a brake surface ring member mounted within said brake housing and spaced an axial distance from said thread inlet opening and having an annular opening arranged coaxially to the axis of said brake housing;

a circular brake element cooperating with said brake surface ring for applying a braking action on running thread passing through said annular opening in said brake surface ring;

an arcuate by-pass passage formed within said brake housing and extending laterally of said annular opening in said brake surface ring for receiving thread during threading thereof through said brake housing to by-pass said cooperating brake element and brake surface ring; and a slot in said brake surface ring extending from said by-pass passage in a spiral curve to said annular opening of said brake surface ring for allowing the running thread to pass from said by-pass passage into said annular opening of said brake surface ring after threading thereof through said brake housing and upon start-up of the running thread through said thread brake.

* * * * *